US009919908B2

(12) United States Patent
Sweeny et al.

(10) Patent No.: US 9,919,908 B2
(45) Date of Patent: Mar. 20, 2018

(54) CENTERING BELL QUICK CHANGE SYSTEM

(71) Applicants: Kevin Sweeny, Willoughby, OH (US); Rishieram Samaroo, Willoughby, OH (US)

(72) Inventors: Kevin Sweeny, Willoughby, OH (US); Rishieram Samaroo, Willoughby, OH (US)

( * ) Notice: Subject to any disclaimer, the term of this patent is extended or adjusted under 35 U.S.C. 154(b) by 6 days.

(21) Appl. No.: 14/923,528

(22) Filed: Oct. 27, 2015

(65) Prior Publication Data

US 2016/0122169 A1 May 5, 2016

Related U.S. Application Data

(60) Provisional application No. 62/073,333, filed on Oct. 31, 2014.

(51) Int. Cl.
*B67C 3/26* (2006.01)
*B67C 3/22* (2006.01)
*B67C 3/00* (2006.01)

(52) U.S. Cl.
CPC ..... *B67C 3/26* (2013.01); *B67C 3/002* (2013.01); *B67C 3/225* (2013.01); *B67C 2003/266* (2013.01); *B67C 2003/2657* (2013.01); *B67C 2003/2668* (2013.01)

(58) Field of Classification Search
CPC ..... B67C 2003/266; B67C 2003/2668
USPC ..... 141/90–92, 144–147, 269, 369–372, 392
See application file for complete search history.

(56) References Cited

U.S. PATENT DOCUMENTS 2,913,016 A * 11/1959 Luther ..... B67C 3/16 141/147
3,048,206 A * 8/1962 Keller ..... B67C 3/26 141/371
3,183,946 A * 5/1965 Tidwell ..... B67C 3/26 141/371
3,742,989 A * 7/1973 Campbell ..... B67C 3/26 141/165
4,014,372 A * 3/1977 Dichiara ..... B67C 3/26 141/286
4,126,163 A * 11/1978 Hartness ..... B67C 3/26 141/269
4,691,748 A 9/1987 Gilmour
6,470,922 B2 * 10/2002 Sindermann ..... B67C 3/10 141/37
7,753,096 B2 * 7/2010 Poeschl ..... B67C 3/26 141/369
8,291,948 B1 * 10/2012 Marks ..... B67C 3/242 141/369
8,496,031 B2 7/2013 Jenne
9,010,385 B2 * 4/2015 Duval ..... F16L 27/11 141/266

* cited by examiner

*Primary Examiner* — Timothy L Maust
(74) *Attorney, Agent, or Firm* — Porter Wright Morris & Arthur, LLP

(57) ABSTRACT

An adapter system for a beverage can filling valve for quick connection/disconnection of multiple centering bells used to fill differently sized cans and a CIF assembly.

18 Claims, 6 Drawing Sheets

CENTERING BELL QUICK CHANGE SYSTEM

CROSS-REFERENCE TO RELATED APPLICATIONS

This application claims the priority benefit of U.S. provisional patent application No. 62/073,333 filed on Oct. 31, 2014, the disclosure of which is expressly incorporated herein in its entirety by reference.

TECHNICAL FIELD

The invention relates to an adapter system for an automatic beverage filling machine for quickly attaching and detaching differently sized centering bells and clean in place devices.

BACKGROUND

Beverage cans are sometimes filled by automated container filling systems. In such a system, an empty can is engaged with a filling valve creating a seal and the beverage dispensed from a pressurized tank through the valve and into the can. In the filling process, a plurality of cans move in a line through a rotary filler having multiple valves. Empty cans are presented to each filling valve as the rotary filler turns. The empty cans must be correctly centered beneath the filling valve to avoid damage to the can, foaming, or spillage of product. Centering devices for cans, such as centering bells, specifically fit the opening/body of the can to be filled and allow a minute amount of clearance in order to fill the can quickly.

Beverage cans vary in design but share certain dimensions for lid diameter, body diameter, and overall height. Current known common lid diameters are 200, 202, 204, 206, and 209 millimeters. Current known body diameters are 202, 204, 207.5, 211, 300, and 307 millimeters. Current known can height dimensions range from 307 to 710 millimeters. Different centering bells correspond to each can size.

Presently, when a change in can size is scheduled for a line, all of the centering bells are disconnected from each of the valves, and centering bells sized for the lid diameter and body diameter of that new can are connected. A problem exists in that changing the bells requires stopping the line for a considerable amount of time to disconnect or unscrew all of the bells and reconnect the appropriate bells for the new can size. For a filler having multiple valves (for example, 72), the time required to change each centering bell consumes valuable time that reduces production time. A need exist for an adapter that allows a filling valve to quickly and easily accept a variety of centering bells used for differently sized cans.

Existing centering bells must be screwed onto the valve housing using a torqueing tool. Over torqueing can ruin the screw threads of the bell. If a bell is dropped, a slight bend in the threads can disable the bell. A need exists for means to attach bells to a filler valve without the need for complicated tools to quickly connect and disconnect the bells.

In addition, filling lines are typically cleaned to maintain flavor integrity and cleanliness of the filling apparatus. Currently, a clean-in-place (CIP) system that has a cup that replaces the centering bell is screwed on after the bell is removed. Removing each bell and connecting the cup to each valve is time consuming—taking many hours to remove each bell, attach each cup, remove the cup and reattach the bell to run a product. A need exists for a method and system to reduce the amount of time required to connect and disconnect a CIP assembly to reduce line down time and afford the maximum amount of time to run product.

SUMMARY OF THE DISCLOSURE

The present invention overcomes the shortcomings of existing devices by providing a quick-change adapter system for centering bells and CIP assemblies for can filling valves. The present invention comprises an adapter for multiple sized bells that center a container to be filled with a fluid. The present invention is a fast connect/disconnect system that allows bells and CIP assemblies to be changed quickly and easily when a change in the line to a different size can occurs or when a filler is scheduled to be cleaned.

The present invention comprises new centering bells that attach to the adapter. The new bells eliminate difficult and timely disconnection and reconnection when a different sized can is run on a beverage filling line. The present invention reduces downtime and allows an operator to change a bell in seconds. Typically, changing 72 centering bells using existing systems takes 1-2 hours. With the present invention, the time required can be reduced to less than 10 minutes.

The present invention further comprises a quick change CIP assembly for use with the adapter. The CIP assembly reduces time to connect/disconnect the CIP from 2-4 hours to about 20 minutes.

As used herein, the term beverages includes carbonated beverages (beer, sodas or carbonated waters), non-carbonated beverages, energy drinks, and the like, whether cold or hot filled.

The term cans includes those made from aluminum, steel, plastic and any combination thereof.

The invention comprises components adapt a beverage can filling valve to enable quick connection/disconnection of multiple centering bells used to fill differently sized cans and a CIP assembly.

In an embodiment, the invention comprises a plurality of improved centering bells that are quickly connected to/released from a filling valve for a beverage can. Each bell has a generally cylindrical shape having a first end and a second end. The first end is sized to center a specific can. The second end comprises three equi-angularly disposed lugs about a first y-axis of an internal wall. The lugs are substantially in line with each other. The second end comprises three equi-angularly disposed brackets about a second y-axis of the internal wall. Each bracket comprises an indentation. The brackets are substantially in line with each other.

The system comprises an filling valve adapter to quickly connect to/release from a plurality of centering bells and/or a clean-in-place (CIP) assembly. The adapter is generally cylindrical and comprises a first section and a second section. The second section has a smaller circumference than the first section. The first section having an opening threadably coupled to the filling valve in a water-tight fashion. The interface between the sections forms a rim on an internal wall of the adapter and a lip on the exterior. The rim has three equiangularly spaced holes that extend from a top of the rim to an outside surface on an underside of the first section at the intersection of the second section. Each hole houses a ball/spring loaded plunger. Each plunger has a length such that each ball extends from the outside surface of the adapter at the interface of the second section. The second section comprises an external surface comprising three equi-angularly mounting channels.

The system comprises a CIP assembly. The CIP assembly is quickly connected to/released from a filling valve for a beverage can. The CIP assembly comprises a generally cylindrical cup. The cup comprises an attachment end and a lower section. The attachment end comprises three equi-angularly disposed CIP lugs about a first y-axis of an internal wall. The CIP lugs are substantially in line with each other. The cup comprises three equi-angularly disposed CIP brackets about a second y-axis of the internal wall. Each CIP bracket comprises a CIP indentation. The CIP brackets are substantially in line with each other. The lower section is formed to accept a retaining ring, at least one CIP o-ring, and a CIP manifold. The CIP manifold has a connector for connecting the cup to a CIP system.

The system comprises a tool to connect/release the adapter to/from a filling valve for a beverage can. The tool had a cylindrical shape and corresponds in diameter to the smaller diameter of the adapter. The tool comprises an open end. The open end has a wall that terminates in three spaced tabs. Each tab corresponding to a slot at an entrance of one of the channels of the adapter. The tool has an opposite end that comprises a protrusion. The protrusion is shaped to accept a turning implement.

In an embodiment, the system is used to quickly attach and release centering bells and clean-in-place (CIP) assemblies for a filling valve for a beverage can. the system comprises a) a plurality of centering bells, each sized to center a specific sized can;

b) a CIP assembly;

c) an adapter connected to the filling valve at a first end and having a second end that releasably receives the centering bells and CIP assembly; and d) a tool to attach and remove the adapter from the valve.

In an embodiment, each bell has a second end diameter that allows the lugs to be engaged by one of the channels of the adapter. Each CIP cup has an upper section with an inner diameter that allows the smaller diameter outer wall of the adapter to be axially inserted within the upper section. Each bell and CIP cup and the adapter have respective center axes which are substantially in line with each other. The adapter, bells, CIP cup and tool are rotatable about a rotation axis.

In an embodiment, an exterior wall of the adapter comprises an indicator that aligns to a complementary indicator on an exterior wall of a bell or CIP cup to show that the bell/CIP cup is attached correctly.

In an embodiment, an exterior wall of the bell provides a surface to make it easier to applying a manual twisting force to attach/disconnect the bell to the adapter. In an embodiment, the surface may be textured or etched or contain protrusions.

In an embodiment, the adapter comprises an o-ring that fits to a groove on the underside of an outside first diameter of the adapter and engages a top of the bell/CIP cup.

The method of quickly attaching a centering bell/CIP assembly to a filler valve used to fill a beverage can with a beverage comprises the steps of a) threading the adapter of onto the valve using the tool; b) aligning the lugs of a bell or CIP cup with an opening of the channels of the adapter; and c) rotating the bell/CIP cup in the direction of an end of each channel, which engages the ball of each plunger with one of the indentations, thereby locking the rotation of the bell/CIP cup with respect to the adapter.

The system is constructed of stainless steel and provides long use.

As used herein, "approximately" means within plus or minus 25% of the term it qualifies. The term "about" means between ½ and 2 times the term it qualifies.

The compositions and methods of the present invention can comprise, consist of, or consist essentially of the essential elements and limitations of the invention described herein, as well as any additional or optional ingredients, components, or limitations described herein or otherwise useful in compositions and methods of the general type as described herein.

Numerical ranges as used herein are intended to include every number and subset of numbers contained within that range, whether specifically disclosed or not. Further, these numerical ranges should be construed as providing support for a claim directed to any number or subset of numbers in that range or to be limited to the exact conversion to a different measuring system, such, but not limited to, as between inches and millimeters.

All references to singular characteristics or limitations of the present invention shall include the corresponding plural characteristic or limitation, and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

Terms such as "top," "bottom," "right," "left," "above", "under", "side" "front", "below" "upper", "back" and the like, are words of convenience and are not to be construed as limiting.

DETAILED DESCRIPTION OF THE INVENTION

The disclosure is directed to a quick connect/disconnect system that allows beverage can filling valve centering bells and CIP assemblies to be connected/disconnected quickly and easily when running a different size can or cleaning an automated filling line.

Figure 1:
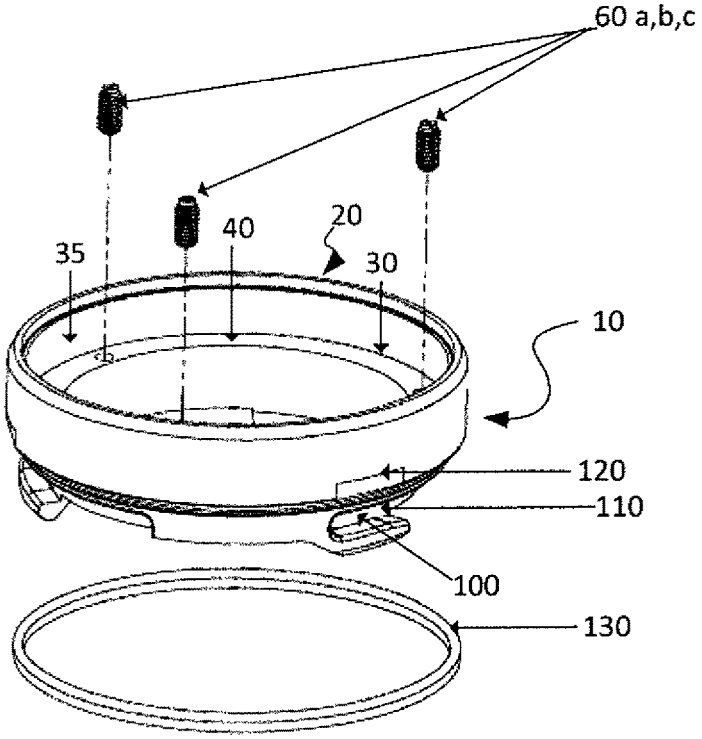
FIG. 1 is a perspective view of an embodiment of the adapter from a front angle showing the end of the adapter that connects to the valve and the o-ring at the opposite end.

Referring now to the drawings, FIG. 1 illustrates a first embodiment of the adapter 10 for attaching to a beverage filling valve. The adapter has a cylindrical shape with a top opening 20 adapted to connect and disconnect to a lower portion of the valve housing that typically receives a centering bell. In an embodiment, the top opening connects to the valve by screw threads on an internal wall 35. The adapter connects to the housing in a water-tight fashion.

The adapter comprises an annular collar 30 at the end of the threads defining the mouth of the adapter. The collar comprises an inwardly directed rim 40 formed therein extending completely around the interior wall of the adapter.

Figure 2:
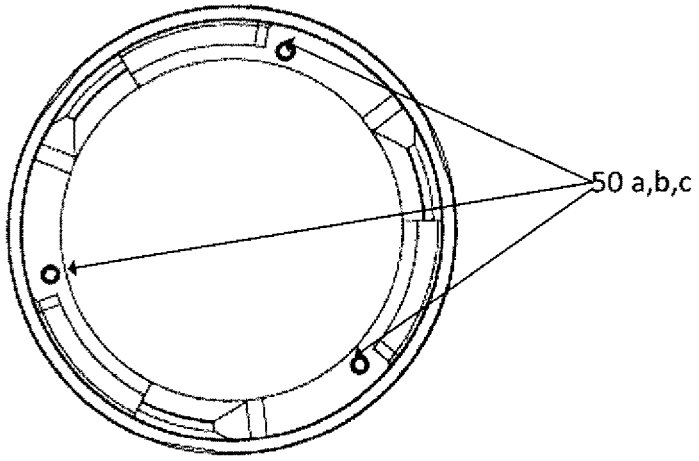
FIG. 2 is a bottom plan view of the adapter showing the end of the adapter that connects to the bells and the CIP assembly.
Figure 3:
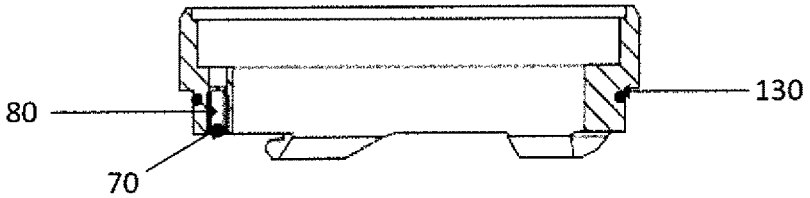
FIG. 3 is a cross sectional view of the adapter.
Figure 5:
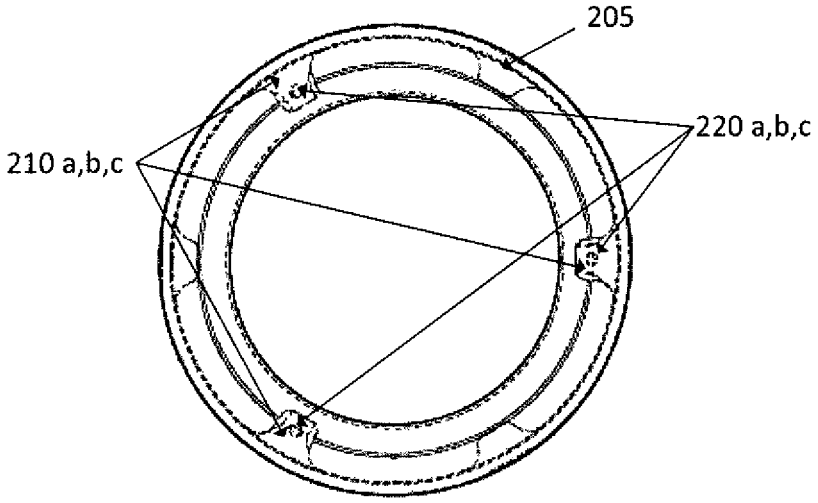
FIG. 5 is a top plan view of a bell showing the opening of the bell that connects to the adapter.
Figure 7:
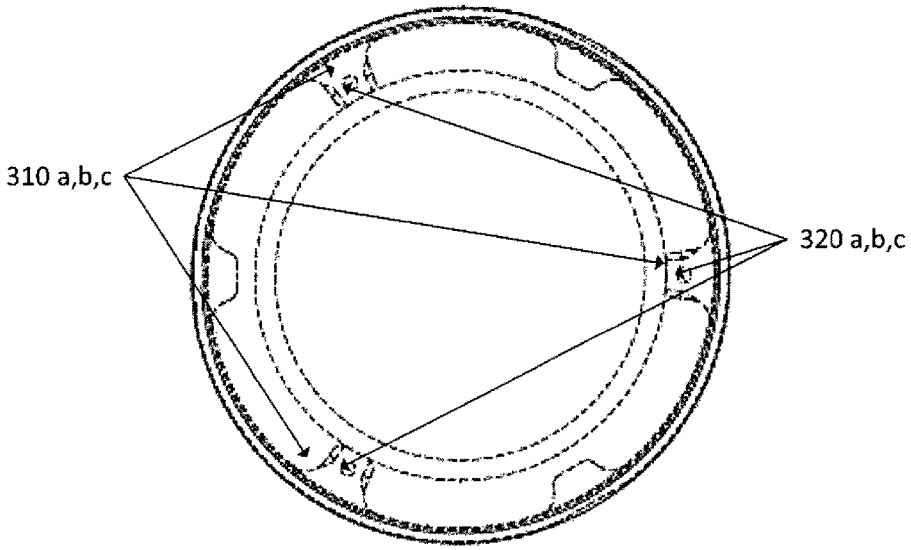
FIG. 7 is a top plan view of a CIP cup showing the opening of the CIP cup that connects to the adapter.
Figure 8:
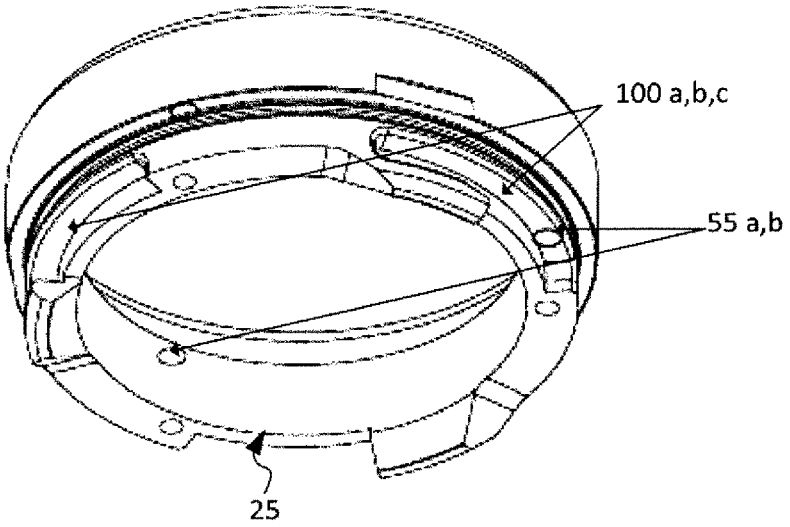
FIG. 8 is a perspective view of an embodiment of the adapter from a front angle showing the end of the adapter that connects to the bells and the CIP assembly.

The adapter comprises at least one cylindrical hole formed in the rim. In a preferred embodiment, the adapter comprises three equally spaced holes 50 *a,b,c* (see FIG. 2). A ball/spring loaded plunger 60 *a,b,c* is inserted in each hole, as shown in FIG. 1. Spring-loaded plungers are known in the art and are releasably held in a retracted position against the operation of a spring. The ball spring plunger is of the conventional type, and generally includes a protrusion or ball 70 (see FIG. 3) resiliently disposed, by a spring 80, against an interior edge of the plunger. The ball of the spring plunger acts as a protrusion for mating with the indentation 220 *a,b,c* of each bracket 210 *a,b,c* of the centering bells (shown in FIG. 5) and each indentation 320 *a,b,c* of each bracket 310 *a,b,c* of the CIP cups (shown in FIG. 7 and described below). Although a ball spring plunger has been described, it will be understood by those skilled in the art that other mechanisms can also be used to perform the function of the plunger, such as a resilient cantilever spring, a bevel spring, and the like.

The rim of the adapter comprises at least one duct 55 *a,b* that acts as a drain in the adapter during cleaning.

Figure 6:
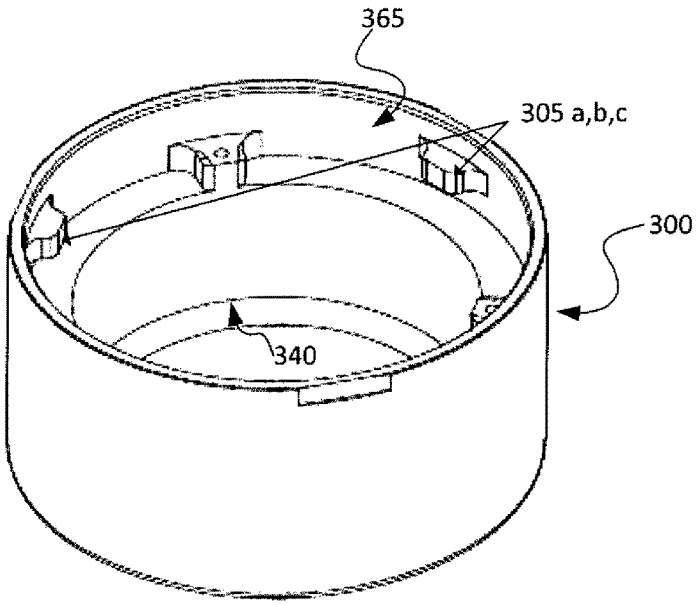
FIG. 6 is a perspective view of an embodiment of a CIP cup showing the end of the CIP cup that connects to the adapter.

At the opposite end of the adapter from the top opening is a bottom opening 25. The bottom opening is at second, smaller diameter wall of the adapter that extends from a terminus of a first diameter of the inner wall 35 of the adapter having the top opening. The difference in diameters forms the rim 40 of the adapter, so that the ball of each spring plunger extends though the rim into space at the exterior of the smaller diameter wall. On the internal wall of the adapter, the bottom opening is the terminus of the mouth. On the external wall of the smaller diameter wall, the adapter comprises at least one channel 100. In a preferred embodiment, the adapter comprises three, equi-angularly evenly spaced channels 100 *a,b,c* for engaging each lug 205 *a,b,c* of the centering bell (see FIG. 4) or lug 305 *a,b,c* of the CIP cup (FIG. 6). As shown in FIG. 1, each of the channels (only 2 are shown) includes a slot 110 where the lug enters each channel.

The adapter comprises an indicator 120 on an exterior wall at the terminus of the first diameter exterior wall. The indicator is an embossment, etched line, arrow and the like that aligns to a complementary indicator on an exterior wall of the bell or CIP cup to show the operator that the bell/CIP cup is attached correctly.

The adapter comprises an o-ring 130 that fits to a groove on the underside of the outside first diameter of the adapter. The o-ring provides a water-tight seal between the adapter and the bell/CIP cup.

Figure 4:
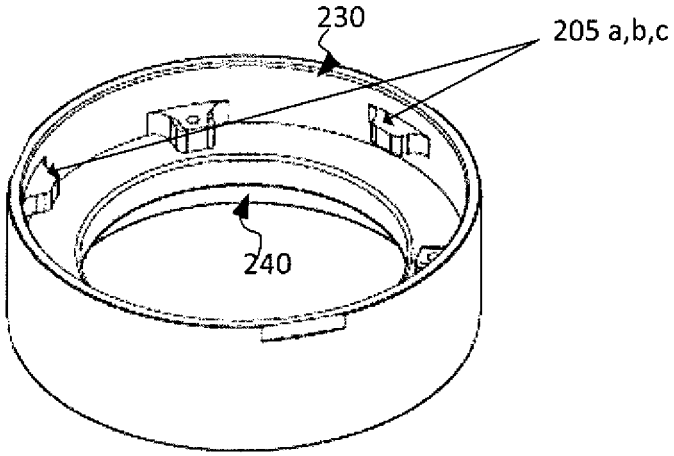
FIG. 4 is a perspective view of an embodiment of a bell showing the end of the bell that connects to the adapter.

As shown in FIG. 4, the bell of the invention is formed to fit the adapter. The invention comprises multiple bells sized to accommodate differently sized cans at the can-end and fit the adapter at an attachment end. Each bell has a cylindrical shape. The attachment end of the bell has an outer diameter corresponding to the first diameter of the adapter. An upper section 230 of the bell has an inner diameter that allows the smaller diameter outer wall of the lower end of the adapter to be axially inserted within the upper section of the bell. Spaced below the opening of the upper section on an interior wall is at least one lug 205. In an embodiment, the bell has 3 equi-angularly evenly spaced lugs 205*a,b,c*. Each lug is shaped to enter a corresponding slot of each channel on the adapter. At a bottom of the upper section of the bell, at least one bracket 210 extends from an interior wall. In an embodiment, three brackets 210*a,b,c* extend into an interior of the upper section of the bell. Each bracket comprises an indentation 220*a,b,c* that is positioned to engage a corresponding ball of the spring plunger of the adapter. The upper section of the bell is connected to a lower section 240 of the bell. The lower section is sized to fit to and fill a particularly sized can.

As shown in FIG. 6, the CIP assembly comprises a CIP cup 300. Each cup has a cylindrical shape. An attachment end 365 of the cup has an outer diameter corresponding to the first diameter of the adapter. An upper section 330 of the cup has an inner diameter that allows the smaller diameter outer wall of the adapter to be axially inserted within the upper section of the CIP cup. Spaced below the opening of the upper section on an interior wall is at least one cup lug 305. In an embodiment, the cup has 3 equi-angularly evenly spaced lugs 305*a,b,c*. Each cup lug is shaped to enter a corresponding slot of each channel on the adapter. At a bottom of the upper section, at least one cup bracket 310 extends from an interior wall. In an embodiment, three brackets 310*a,b,c* extend into an interior of the upper section. Each cup bracket comprises a cup bracket indentation 320*a,b,c* that is positioned to engage a corresponding ball of the spring plunger of the adapter. The upper section of the cup is connected to a lower section 340 of the cup. The lower section is formed to accept retaining ring 350, at least one CIP o-ring 360*a,b* and a CIP manifold 370. The CIP manifold has a connector to a hose 380 and a hose adapter 390 for connecting to a CIP system.

Figure 9:
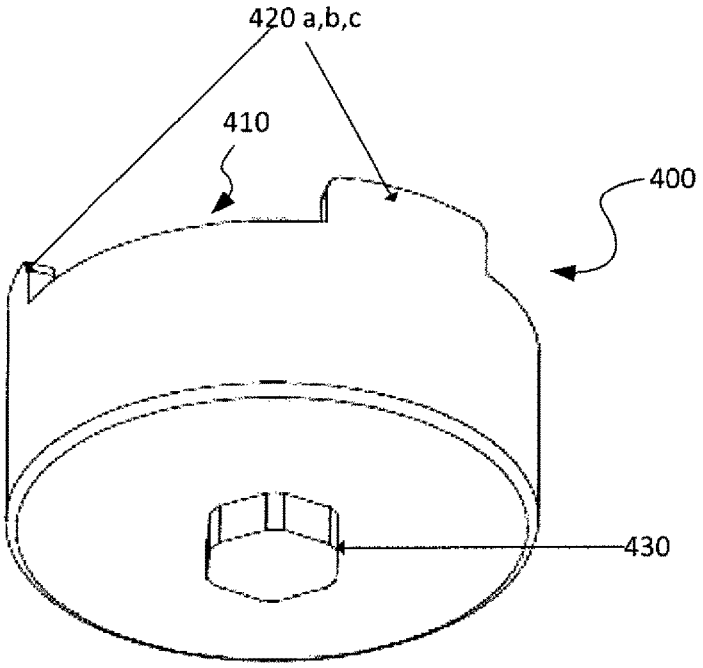
FIG. 9 is a perspective side view of the tool of the system.
Figure 10:
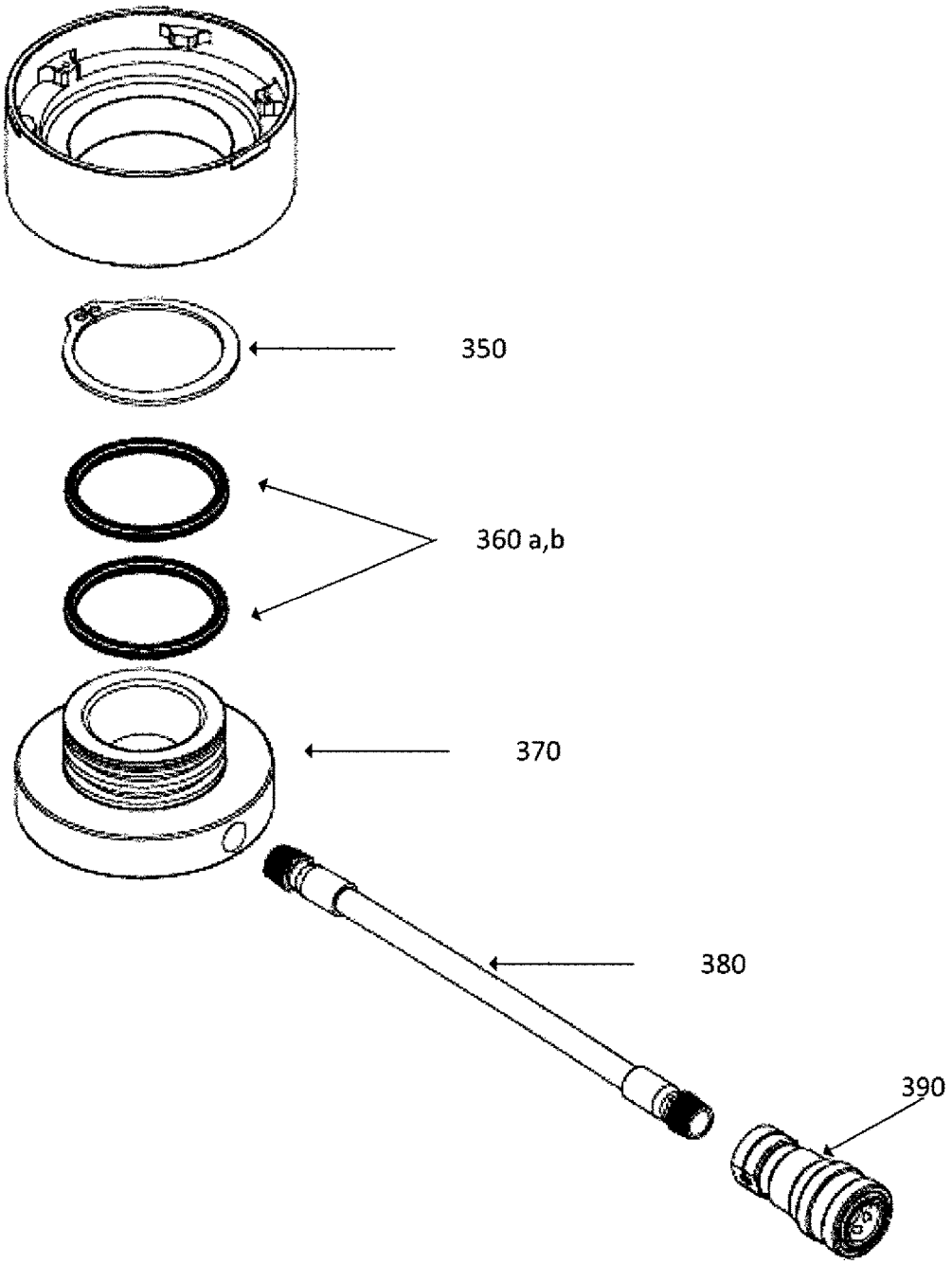
FIG. 10 is a blown apart perspective view of a CIP assembly.
Figure 11:
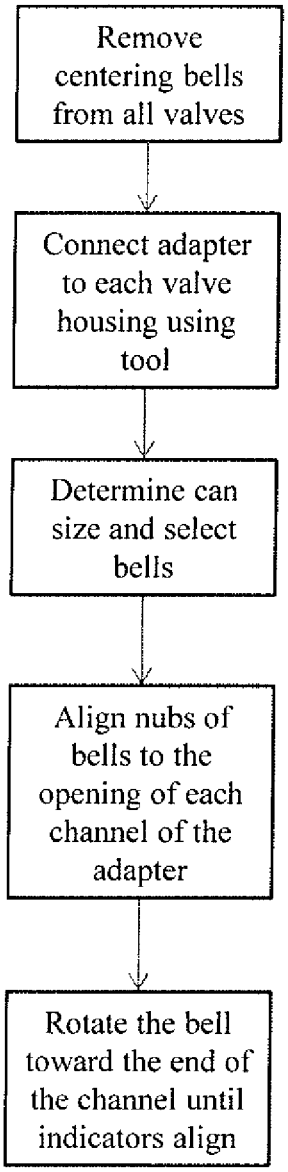
FIG. 11 is a flow chart of a method of connecting the adapter and bell of the system.

The adapter to attached and detached from the valve housing using the tool 400 depicted in FIG. 9. The tool has a cylindrical shape corresponding in diameter to the smaller diameter of the adapter. At an open end 410 of the tool, the wall comprises three tabs 420*a,b,c*. Each tab correspond to each slot of the adapter. The end opposite the open end of the tool is partially or entirely closed and includes a centered protrusion 430. The protrusion is shaped to accept a ratchet wrench or other similar implement.

The adapter, bells CIP cup and tool are rotatable about a rotation axis.

To attach the adapter to the housing of a filler valve, the centering bell is removed (if present) and the adapter is screwed into the threads of the valve using the tool by ratcheting to adapter with the tool until completely threaded onto the housing. An o-ring used for the centering bell may be retained to seal the adapter to the housing.

To attach a bell to the adapter, the opening of the upper section of the bell and the lugs are aligned with the slots of adapter. The bell is rotated (about 15 degrees) in the direction of the end of the channels. When each lug meets the end of each channel, the ball of the spring plunger engages the indentation and automatically locks the rotation of the bell with respect to the adapter. When the indicator of the bell and the adapter align, the bell is correctly positioned.

To detach a centering bell from the adapter, the bell is turned in an opposite direction that disengages each ball, slides each lug out of each channel and out the slot.

The exterior wall of the bell provides suitable surfaces for manually applying a twisting force to attach/disconnect the bell to the adapter.

The CIP assembly is attached and detached in a similar fashion.

The system replaces existing centering bells.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected. Additional features of the invention will become apparent to those skilled in the art upon consideration of the description. Modifications may be made without departing from the spirit and scope of the invention.

We claim:

1. A quick-change filling valve adapter for non-threadably connecting a centering bell and/or a clean-in-place (CIP) assembly to a beverage filling machine, the filling valve adapter comprising a first annular section and a second annular section, the second annular section having a smaller circumference than the first annular section, the first annular section having a threaded internal wall for threadably coupling the adapter to a filling valve of the beverage filling machine in a water-tight fashion, the adapter further comprising an inwardly directed rim extending around an internal wall of the adapter, the second annular section comprising an external surface having a plurality of mounting channels arrayed about an external surface of the second annular section, each mounting channel adapted to receive one of a plurality of lugs arrayed about an interior surface of a centering bell or a CIP assembly such that the centering bell or CIP assembly can be rotatingly and releasably mounted to the adapter.

2. A system for quickly and releasably attaching a centering bell to a filling valve for a beverage can, comprising:

a) an annular centering bell, the centering bell comprising a first end and a second end; the first end sized to center a specific can, the second end comprising i) a plurality of equi-angularly disposed lugs about an internal wall of the centering bell, the lugs circumferentially aligned with each other; and b) the filling valve adapter of claim 1 for mounting the annular centering bell to the filling valve.

3. The system of claim 2 wherein the inner diameter of the second end of the centering bell is larger than the outer diameter of the second annular section of the adapter such that the second annular section of the adapter can be axially inserted into the second end of the centering bell and the centering bell rotated with respect to the adapter such that each lug in the second end of the centering bell is received by one of the channels of the adapter.

4. The system of claim 2 wherein, when the centering bell and the adapter each have an indicator on an exterior wall thereof, the indicators are aligned with one another when the centering bell is attached correctly to the adapter.

5. The adapter of claim 1, further comprising an o-ring fit into a groove located on the exterior of the adapter, the o-ring adapted to provide a water-tight seal between the adapter and a centering bell or CIP assembly.

6. The filling valve adapter of claim 1, the second annular section having a bottom surface, and further comprising a plurality of spring loaded plungers, each plunger having a protrusion that resiliently extends away from the bottom surface of the second annular section, the protrusions of the spring loaded plungers adapted to engage with indentations provided on the centering bell or CIP assembly when the lugs of the centering bell or CIP assembly are received within the mounting channels of the second annular section.

7. The filling valve adapter of claim 6, wherein said spring loaded plungers are arranged such that each protrusion thereof extends away from the bottom surface of the second annular section between a pair of adjacent mounting channels.

8. The filling valve adapter of claim 6, wherein the spring loaded plungers comprise spring loaded ball plungers.

9. The filling valve adapter of claim 6, wherein rim of the adapter comprises at least one drainage duct.

10. The filling valve adapter of claim 1, wherein the adapter has three mounting channels equi-angularly disposed on the bottom surface of the second annular section of the adapter.

11. The filling valve adapter of claim 6, the adapter has three of said mounting channels equi-angularly disposed on the bottom surface of the second annular section of the adapter, and further wherein the adapter has three of said spring loaded plungers equi-angularly disposed about the bottom surface of the second annular section.

12. The system of claim 2, further comprising a CIP assembly mountable to the filling valve using the adapter, the CIP assembly comprising an annular cup comprising an attachment end and a lower section for operative connection to a CIP system, the attachment end of the CIP assembly comprising a plurality of equi-angularly disposed CIP lugs about an internal wall of the CIP assembly, the CIP lugs circumferentially aligned with each other.

13. The system of claim 12 wherein the inner diameter of the attachment end of the CIP assembly is larger than the outer diameter of the second annular section of the adapter such that second annular section of the adapter can be axially inserted into the attachment end of the CIP assembly and the CIP assembly rotated with respect to the adapter such that each CIP lug in the attachment end of the centering bell is received by one of the channels of the adapter.

14. An annular quick-change filling valve adapter for non-threadably connecting a centering bell or a clean-in-place (CIP) assembly to the filling valve of a beverage filling machine, the filling valve adapter comprising:

(a) an internally threaded first section adapted for having upper end coupling the adapter to a filling valve of the beverage filling machine in a water-tight fashion;

(b) a second section comprising an external surface and a bottom surface;

(c) a plurality of spring loaded plungers, each plunger having a protrusion that extends away from the bottom surface of the second section, the protrusions of the spring loaded plungers adapted to engage with indentations provided on the centering bell or CIP assembly; and (d) a plurality of mounting channels arrayed about the external surface of the second section, each mounting channel adapted to receive one of a plurality of lugs arrayed about an interior surface of the centering bell or CIP assembly such that the centering bell or CIP assembly can be rotatingly and releasably mounted to the adapter.

15. The adapter of claim 14, wherein said spring loaded plungers are arranged such that each protrusion thereof extends away from the bottom surface of the second annular section between a pair of adjacent mounting channels.

16. The filling valve adapter of claim 15, wherein the spring loaded plungers comprise spring loaded ball plungers.

17. The filling valve adapter of claim 14, wherein the adapter has three mounting channels equi-angularly disposed on the bottom surface of the second annular section of the adapter.

18. The filling valve adapter of claim 17, wherein the adapter has three of said spring loaded plungers equi-angularly disposed about the bottom surface of the second annular section, and further wherein said spring loaded plungers are arranged such that each protrusion thereof extends away from the bottom surface of the second annular section between adjacent mounting channels.

* * * * *